US005733502A

United States Patent [19]

Margaria et al.

[11] Patent Number: 5,733,502

[45] Date of Patent: Mar. 31, 1998

[54] FERROALLOY FOR INOCULATION OF SPHERULITIC GRAPHITE IRONS

[75] Inventors: Thomas Margaria, Passy; Robert Herold, Domancy, both of France

[73] Assignee: Pechiney Electrometallurgie, Courbevois, France

[21] Appl. No.: 882,253

[22] Filed: Jun. 25, 1997

[30] Foreign Application Priority Data

Jun. 26, 1996 [FR] France ..... 96 08151
Feb. 17, 1997 [FR] France ..... 97 02040

[51] Int. Cl.[6] ..... C22C 28/00
[52] U.S. Cl. ..... 420/578
[58] Field of Search ..... 420/578, 581

[56] References Cited

FOREIGN PATENT DOCUMENTS 0 357 521 A 3/1990 European Pat. Off. .
295192 10/1991 Germany ..... 420/578
579813 1/1982 Japan ..... 420/578
83 03848 A 10/1983 WIPO ..... C22C 33/08

OTHER PUBLICATIONS

Patent Abstracts of Japan, vol. 012, No. 005, (C–467), 8 Jan. 1988.
Giesserei–Praxis, vol. 17, Sep. 1992, Berlin, DE, pp. 247–254, XP002026066, C. Pelhan et al., "Calcium in der Vorlegierung FeSiMg(Ca)".
Durrer/Volkert: "Metallurgie der Ferrolegierungen" 1972, Springer–Verlag, Berlin Heidelberg New York, 2. Auflage XP002026091, pp. 530–533.

*Primary Examiner*—Deborah Yee
*Attorney, Agent, or Firm*—Pollock, Vande Sande & Priddy

[57] ABSTRACT

A ferrosilicon-based ferroalloy for inoculation of spherulitic graphite irons containing (by weight) from 0.005% to 3% rare earths, 0.005% to 3% bismuth, lead and/or antimony, and 0.3% to 3% calcium, and is characterized by the fact that Si/Fe>2 and contains from 0.3 to 3% magnesium. The ferroalloy exhibits improved granulometric stability during storage.

5 Claims, No Drawings

FERROALLOY FOR INOCULATION OF SPHERULITIC GRAPHITE IRONS

FIELD OF THE INVENTION

The invention relates to a ferrosilicon-based ferroalloy intended for the inoculation treatment of spherulitic graphite irons.

BACKGROUND OF THE INVENTION

The treatment of molten irons for the purpose of imparting to them a spherulitic graphite structure comprises a sequence of four operations: carburization, desulfurization, spheroidizing, and inoculation. This last operation is normally carried out using a ferrosilicon-based alloy incorporating various additives. One product widely employed for this purpose is the alloy called SPHERIX®, which is sold by the Applicant and covered by French Patent No. 2511044, filed Aug. 4, 1981 in the name of the NOBEL-BOZEL Company. SPHERIX is a ferrosilicon containing from 0.005% to 3% rare earths and from 0.005% to 3% of one of the elements bismuth, lead, and/or antimony.

This type of alloy contains approximately 1 to 1.5%, and always at least 0.6%, calcium. Indeed, experience shows that this element improves the bismuth, lead and/or antimony yield at the time the alloy is produced and helps to distribute these elements homogeneously within the alloy.

The use of these alloys over many years has confirmed their excellent inoculation power, while, however, revealing a problem arising from the preparation thereof. In fact, during storage the product tends to split, and the granulometry thereof tends toward an increased proportion of fines. During final packaging, a significant percentage of the alloy possessing excessively fine granulometry must be removed to meet the requisite specifications.

Patent EP 0357521 held by the Applicant relates to an alloy combining iron-inoculation and iron-nodulizing properties and having the following composition (% by weight):

Si:41–65 Mg:2–30 Bi:0.1–4 Ca, Ba, Sr<4 each Al<1.5, the remainder being Fe. When incorporating compositions approximating that exemplified in the patent, the alloy exhibits the same tendency to split during storage.

SUMMARY OF THE INVENTION

The invention is intended to solve this problem while continuing to ensure the effectiveness of the alloy used as an inoculant. It concerns an alloy of the kind described in Patent No. FR 2511044; that is, a ferrosilicon containing (by weight) 0.005% to 3% rare earths and from 0.005% to 3% bismuth, lead and/or antimony, as well as 0.3 to 3% calcium, and is characterized by the fact that the Si/Fe ratio is greater than 2 and preferably 2.5, and that the alloy also contains magnesium in a proportion of between 0.3 and 3%.

DESCRIPTION OF THE PREFERRED EMBODIMENT

Having observed the progressive adverse reduction over time of the granulometry of the bismuth-, lead-, or antimony-based inoculants, the Applicant studied this phenomenon and linked it to the decomposition, caused by atmospheric moisture, of a calcium-bismuth phase collected at the grain boundaries of the inoculants.

Calcium is an additive element required to fix the bismuth, lead, or antimony, which exhibit poor solubility in the iron-silicon phases. Calcium proves especially important when using bismuth, the most volatile but also the most efficacious of the three elements as regards nucleation of the graphite of the iron, since it allows preservation of a satisfactory bismuth yield.

The Applicant has sought a calcium substitute and has fortuitously found that magnesium prevented losses of bismuth caused by volatilization and ensured the stability of the inoculant when exposed to moisture. In fact, it was observed, unexpectedly, that the binary bismuth-magnesium phases were not attacked by water, as was true, for example, with the $Bi_2Mg_3$ phase.

Even more unexpectedly, it was also discovered that the ternary bismuth-magnesium-calcium phases are also water-resistant, a fact which potentially makes it possible to maintain a certain quantity of calcium in the product.

Accordingly, to obtain at the same time a satisfactory bismuth yield, homogenous distribution of bismuth, lead or antimony in the alloy, granulometric stability of the final product, and a satisfactory inoculating power, the inoculation alloy must contain from 0.3 to 3%, and preferably 0.5 to 2%, by weight calcium, and 0.3 to 3%, and preferably 0.5 to 1.5%, by weight magnesium.

Finally, it was discovered that this result could be achieved only if the ferrosilicon had a high silicon content, and, more precisely, if the Si/Fe ratio was greater than 2 and preferably than 2.5; otherwise the product split during storage.

The alloy can be fed into the molten iron in the form of sifted grains having a granulometry of between 2 and 7 mm or of filled wire containing such grains.

EXAMPLE 1

Three inoculation alloys A, B, C having the following chemical compositions (% by weight) were prepared:

| | Si | Ca | TR | Bi | Al | Mg | Fe |
|---|---|---|---|---|---|---|---|
| A | 71.5 | 1.52 | 0.49 | 1.02 | 0.83 | <0.001 | 23.8 |
| B | 71.8 | 1.37 | 0.47 | 1.04 | 0.78 | 1.03 | 22.7 |
| C | 72.7 | 0.42 | 0.48 | 1.03 | 0.72 | 1.67 | 22.3 |

Alloy A corresponded to a normal SPHERIX® composition; alloys B and C conformed to the invention.

The alloys were ground into fragments, then sifted to a size of between 2 and 7 mm and stored for one month under normal storage conditions. After storage, the alloy A contained 34% by weight of particles less than 2 mm in size and could not be used before being resifted to 2 mm, while alloys B and C contained only 2.5% and 2.2%, respectively, of such particles and, consequently, did not have to be resifted prior to use.

A crucible containing molten iron treated with 0.85% by weight of a Ni-Mg alloy containing 15% Mg was inoculated at 1410° C. using 0.7% by weight of alloy A. The same trial was then repeated using alloys B and C. The three crucibles were used to pour plates 6, 12, and 24 mm in thickness. Optical microscopy was used to measure the average number of spheroids per $mm^2$ in these plates. The results were as follows:

| thickness | 6 mm | 12 mm | 24 mm |
|---|---|---|---|
| A | 390 | 180 | 150 |
| B | 380 | 180 | 155 |
| C | 385 | 185 | 145 |

These results show that the inoculating power of the three alloys is more or less identical.

EXAMPLE 2

An alloy D having the following composition (% by weight) was prepared:

| Si | Ca | TR | Bi | Al | Mg | C | Fe |
|---|---|---|---|---|---|---|---|
| 52.7 | 0.72 | 0.51 | 1.02 | 0.72 | 5.1 | 0.25 | 38.6 |

The alloy was poured, ground into fragments, and sifted so that the totality of the product had a granulometry of between 2 and 7 mm. After storage for three weeks following manufacture, the granulometry thereof was measured again:

product passing through at 5 mm: 100% product passing through at 2 mm: 97% product passing through at 1 mm: 52%.

It was found that this alloy, whose Si/Fe ratio was 1.48, exhibited significant splitting during storage.

What is claimed is:

1. Ferrosilicon-based ferroalloy for inoculation of spherulitic graphite irons and containing (by weight) from 0.005% to 3% rare earths, 0.005% to 3% bismuth, lead and/or antimony, and 0.3 to 3% calcium, wherein the Si/Fe ratio was greater than 2 and wherein it contains from 0.3% to 3% magnesium.

2. Ferroalloy according to claim 1, wherein the Si/Fe ratio is greater than 2.5.

3. Ferroalloy according to claim 1, wherein it contains from 0.5 to 2% calcium.

4. Ferroalloy according to claim 1, wherein it contains from 0.5 to 1.5% magnesium.

5. Ferroalloy according to claim 1, wherein it is added to the iron in the form of filled wire.

* * * * *

UNITED STATES PATENT AND TRADEMARK OFFICE

CERTIFICATE OF CORRECTION

PATENT NO. : 5,733,502
DATED : March 31, 1998
INVENTOR(S) : Thomas MARGARIA

It is certified that error appears in the above-identified patent and that said Letters Patent is hereby corrected as shown below:

On title page, item

[73] Change "Corbevois" to --Courbevoie--

Signed and Sealed this

Eleventh Day of August 1998

Bruce Lehman

*Attest:*

BRUCE LEHMAN

*Attesting Officer*

*Commissioner of Patents and Trademarks*